US007461410B1

(12) United States Patent
Shaffer

(10) Patent No.: US 7,461,410 B1
(45) Date of Patent: Dec. 9, 2008

(54) TOILET ODOR VENTILATING ASSEMBLY

(76) Inventor: Gene P. Shaffer, 5139 Hazeltine Ave., Sherman Oaks, CA (US) 91423

( * ) Notice: Subject to any disclaimer, the term of this patent is extended or adjusted under 35 U.S.C. 154(b) by 0 days.

(21) Appl. No.: 12/079,916

(22) Filed: Mar. 28, 2008

(51) Int. Cl.
*E03D 9/04* (2006.01)

(52) U.S. Cl. ..... 4/213; 4/209 R

(58) Field of Classification Search ..... 4/209 R, 4/213, 216, 219, 347
See application file for complete search history.

(56) References Cited

U.S. PATENT DOCUMENTS 3,805,304 A 4/1974 Ikehata
4,103,370 A 8/1978 Arnold
4,133,060 A 1/1979 Webb
4,165,544 A 8/1979 Barry
5,016,294 A 5/1991 Canovas
5,079,782 A 1/1992 Sim
5,341,521 A 8/1994 Redford
5,355,537 A 10/1994 Redford
6,073,273 A * 6/2000 Tillen ..... 4/214
6,370,703 B1 4/2002 Kim et al.

* cited by examiner

*Primary Examiner*—Huyen Le
(74) *Attorney, Agent, or Firm*—Albert O. Cota

(57) ABSTRACT

A toilet odor ventilating assembly (TOVA) (10) that is designed to be produced either as a kit for modifying a standard toilet assembly or to be integrated on to an original equipment manufacture (OEM) toilet assembly. When produced as a kit, the TOVA (10) can be easily installed onto a standard toilet assembly (160). The TOVA (10) kit is comprised of three major elements: a lower air-flow conduit (12), an upper air-flow conduit (56), and an electrical activation unit (120). The three elements function in combination to effectively eliminate or substantially reduce toilet odors emanating from the toilet bowl (168). The OEM design of the TOVA 10 requires that the toilet bowl (168) include an air inlet opening (200) that has attached an air inlet flange (204) and an air outlet opening (202) that has attached an air outlet flange (214). Between the two flanges is attached a flexible air hose (130) that passes the air flowing from the toilet bowl (168) into the sewer.

19 Claims, 7 Drawing Sheets

TOILET ODOR VENTILATING ASSEMBLY

TECHNICAL FIELD

The invention generally pertains to odor ventilating toilets, and more particularly to a toilet odor ventilating assembly that can be supplied as a kit for modifying a standard toilet assembly or can be integrated into an original equipment manufactured (OEM) toilet assembly.

BACKGROUND ART

The use of flushing toilets has been a necessity in residential homes, business establishments and public facilities for many years. In all the toilet designs a universal problem that exists is the need to eliminate or to reduce odors, bacteria and other offensive vapors that emanate from the toilet bowl after the toilet is used.

There are various toilet designs and methods disclosed in the prior art that have attempted to eliminate or at least reduce the odor emanating problem. The prior art designs and methods include adding additional structural elements to a toilet and the surrounding area, installing filters and/or adding chemicals to the toilet water to neutralize the offensive odors. Generally, the prior art designs, when compared to the instant invention have a relatively large number of structural elements, are difficult to install when supplied in a kit form and require periodic maintenance. As such, none of the prior art designs has found any significant acceptance by the general public.

A search of the prior art did not disclose any industry literature or U.S. patents that read on the claims of the instant application. However, the following U.S. patents are considered related:

| PATENT NO. | INVENTOR | ISSUED |
|---|---|---|
| 5,079,782 | Sim | Jan. 14, 1992 |
| 5,016,294 | Canovas | May 21, 1991 |
| 4,165,544 | Barry | Aug. 28, 1979 |

The U.S. Pat. No. 5,079,782 patent discloses a toilet assembly that includes a toilet bowl having a ventilation conduit that is located adjacent to the back wall of the toilet bowl for ventilating odors from the toilet bowl. The ventilation conduit, which includes a fan, extends around a siphon conduit at a point where the two conduits communicate with a sewer discharge line. Raising the toilet seat cover activates a motion sensor that activates the fan member, thus allowing the objectionable odors to be ventilated directly into the sewer.

The U.S. Pat. No. 5,016,294 patent discloses an odorless toilet that functions with a toilet seat adapter unit that provides a seal around the toilet seat. The toilet seat adapter unit is located between the toilet seat and the upper surface of the rim of the toilet bowl of a conventional toilet and includes a plastic plate that conforms to the toilet seat. A first set of plastic clips are affixed to the lower surface of the plastic plate to prevent the plate from slipping on the rim's upper surface. A flexible plastic hose is looped around the upper surface of the plate and is held in place by a second set of plastic clips. The hose communicates with a vacuum pump or exhaust fan that reduces objectionable odors.

The U.S. Pat. No. 4,165,544 patent discloses a system for eliminating odors from a toilet assembly that includes a toilet bowl and a water tank that is connected by a discharge pipe to the toilet bowl. The water tank includes an overflow passageway that is connected to the discharge pipe so that water in excess of the desired level is dispensed into the toilet bowl and through which the odorous air is withdrawn from the toilet bowl.

For background purposes and as indicative of the art to which the invention is related reference may be made to the remaining patents located in the search:

| PATENT NO. | INVENTOR | ISSUED |
|---|---|---|
| 6,370,703 | Kim, et al | Apr. 16, 2002 |
| 5,355,537 | Redford | Oct. 18, 1994 |
| 5,341,521 | Redford | Aug. 30, 1994 |
| 4,133,060 | Webb | Jan. 9, 1979 |
| 4,103,370 | Arnold | Aug. 1, 1978 |
| 3,805,304 | Ikehata | Apr. 23, 1974 |

DISCLOSURE OF THE INVENTION

The toilet odor ventilating assembly (TOVA) described herein is designed to be provided as a kit that is installed onto a standard toilet assembly or the TOVA can be integrated into an OEM toilet assembly. The TOVA when supplied as a kit utilizes three major elements which makes the TOVA relatively easy to install when compared to prior art odor reducing toilet kits.

When provided in the kit form, the TOVA is adapted to function in combination with a toilet assembly that is comprised of a toilet tank having a water outlet opening and at least one tank attachment bore. The toilet tank is attached to a toilet bowl that includes a front section, a rear section, an upper surface, a lower surface, a pair of bowl mounting bores, a water outlet opening, a plurality of water outlet ports, a sewer opening, a toilet seat and a toilet seat cover. The sewer opening is aligned with a sewer opening located on a floor having an upper surface and a lower surface, wherein the floor's sewer opening terminates with a waste pipe that extends from the lower surface of the floor and to which is connected a sewer pipe.

In its basic design configuration the TOVA is comprised of a) A lower air-flow conduit having a sewer port and an air exhaust port. The sewer port interfaces with the sewer openings located on the toilet bowl and on the floor.

b) An upper air-flow conduit having a lower air exhaust port and an upper air inlet port that interfaces with the water outlet openings located on the toilet tank and the toilet bowl.

c) A motor/fan mounting bracket having an air input port that is aligned with the lower air exhaust port.

d) A motor/fan enclosed within a housing having an air input duct that interfaces with the air input port located on the bracket, and an air exhaust duct that is connected via an air hose which is preferably comprised of a flexible air hose, to the exhaust port located on the lower air-flow conduit.

e) An electrical activating unit having means for controlling the operation of the motor/fan. When the motor/fan is activated an air flow is produced that commences at the toilet bowl from where the air-flow enters through the plurality of the water outlet ports. The air-flow exiting the water outlet ports enters into and exits from the water outlet opening located on the toilet bowl and continues through the air passage area into the lower air exhaust port, the air input port located on the motor/fan mounting bracket, the air input duct located on the motor/fan housing and into the air exhaust duct also located on the motor/fan housing. From the air exhaust duct the air-flow travels through the air hose into the air exhaust port located on said lower air flow conduit and finally the air flow exits through the sewer port, the sewer opening, the waste pipe and into the sewer.

In view of the above disclosure the primary object of the invention is to produce a TOVA that can effectively eliminate or as a minimum reduce objectionable odors that emanate from a toilet bowl.

In addition to the primary object of the invention it is also an object of the invention to produce an odorless toilet assembly that:

- uses a relatively small number of elements when compared to current odor reducing toilets,
- can be integrated into an OEM toilet or supplied in a kit that can be installed on various conventional toilets,
- can be supplied in various colors,
- requires no maintenance with the exception that the battery must be periodically charged,
- can be of various materials,
- is reliable, and
- is cost effective from both a manufacture's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
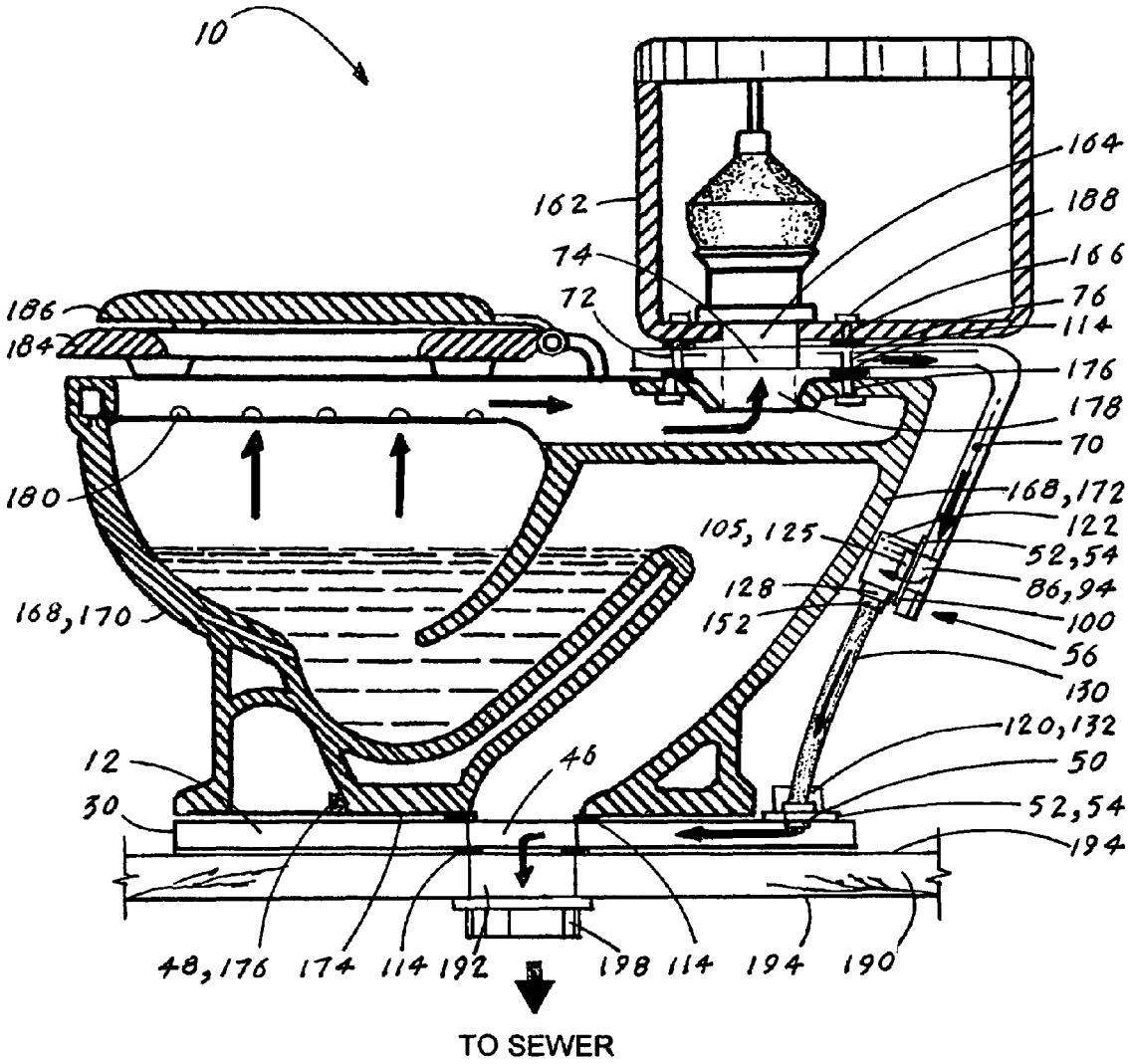
FIG. 1 is a side elevational and cross-sectional view of a toilet odor ventilating assembly attached to a conventional toilet assembly.

The best mode for carrying out the toilet odor ventilating assembly 10 (hereinafter "TOVA 10") is described in terms of a preferred embodiment that can be implemented as either a kit that is easily installed onto a conventional toilet assembly that can be integrated onto a modified OEM toilet assembly.

The kit form of the TOVA 10, as shown in FIGS. 1-9, is adapted to function in combination with a prior art toilet assembly 160, which is comprised of a toilet tank 162, having a water outlet opening 164 and at least one tank attachment bore 166. The toilet tank 162 is attached to a toilet bowl 168 having a front section 170, a rear section 172; an upper surface 173, a lower surface 174, a pair of bowl mounting bores 176, a water outlet opening 178, a plurality of water outlet ports 180, a sewer opening 182, a toilet seat 184 and a toilet seat cover 186. The sewer opening 182 is aligned with a sewer opening 192 located through a floor 190 having an upper surface 194 and a lower surface 196. Attached to the floor's sewer opening 192 is a waste pipe 198 that extends from the lower surface 196 of the floor 190 and to which is connected a sewer pipe.

The kit form of the TOVA 10 is comprised of the following three major elements: a lower air-flow conduit 12, an upper air-flow conduit 56 and an electrical activation unit 120. All the elements can be made of plastic or other similar materials.

Figure 2:
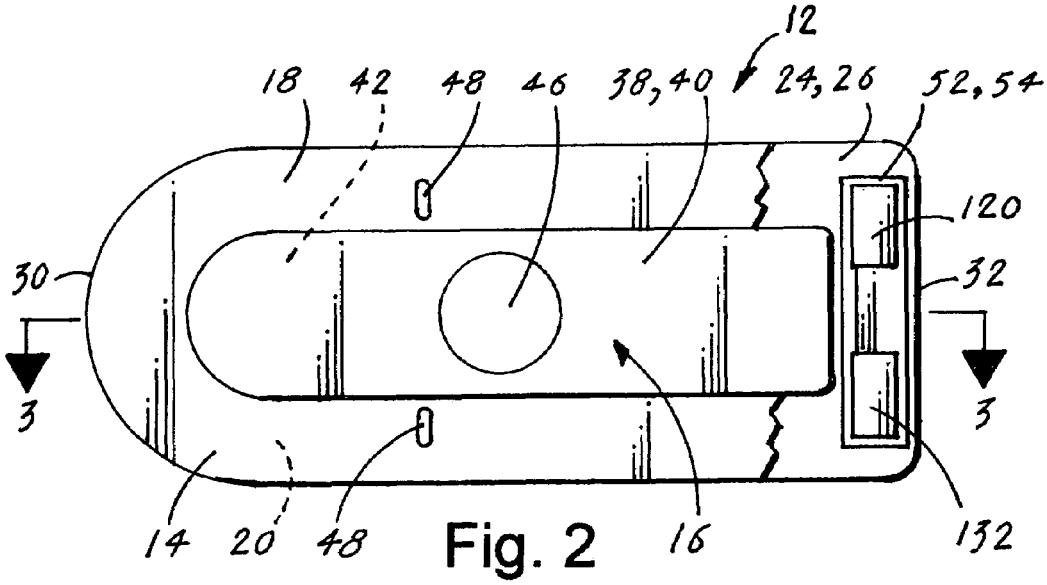
FIG. 2 is a top plan view of a lower air-flow conduit with an upper plate partially removed from a support structure.
Figure 3:
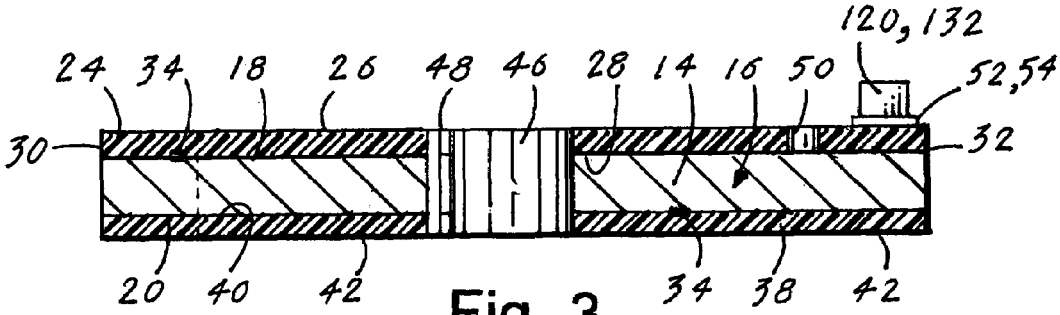
FIG. 3 is a side elevational and cross-sectional view taken along the lines 3-3 of FIG. 2.

The lower air-flow conduit 12 is shown attached to the toilet assembly 160 in FIG. 1, and removed from the toilet assembly 160 in FIGS. 2 and 3. As shown in FIG. 1, the lower air-flow conduit 12 is attached between the lower surface 174 of the toilet bowl 168 and the upper surface 194 of the floor 190. Preferably, the lower air-flow conduit 12 has a perimeter that encompasses the lower surface 174 of the toilet bowl 168 and is comprised of three structural elements: a support structure 14, an upper plate 24 and a lower plate 38. The support structure 14 includes an elongated central opening 16, an upper surface 18 and a lower surface 20. Attached to the conduit's upper surface 18 is an upper plate 24 having an upper surface 26, a lower surface 28, a front end 30 and a rear end 32. The upper plate 24 is dimensioned to follow the perimeter of the support structure 14. The lower surface 28 of the upper plate 24 is attached to the upper surface of the support structure 14 by a plate attachment means 34 that can consist of a water-proof adhesive or the like. The lower plate 38 has an upper surface 40, a lower surface 42, and is dimensioned to also follow the perimeter of the support structure 14, as best shown in FIG. 1, the upper surface of the lower plate 38 is attached to the lower surface 20 of the support structure 14 by the plate attachment means 34.

The lower air-flow conduit 12 also has, as best shown in FIGS. 2 and 3, a sewer port 46, a pair of toilet and conduit mounting bores 48, an air exhaust port 50, and a unit and battery mounting bracket 52.

The sewer port 46 extends through the upper plate 24 and the lower plate 38 and is in alignment with the sewer opening 182 located on the toilet assembly 160. The pair of toilet and conduit mounting bores 48 extend through the upper plate 24, the support structure 14 and the lower plate 38 and are in alignment with the pair of bowl mounting bores 176 located on the toilet assembly 160. The air exhaust port 50 extends through and is adjacent to the rear end 32 of the upper plate 24. The unit and battery mounting bracket 52 is also located adjacent to the rear end 32 of the upper plate 24.

The second major element that comprises the TOVA 10 is the upper air-flow conduit 56 that is shown attached to the toilet bowl assembly 160 in FIG. 1, and removed from the toilet assembly in FIGS. 4-7. The upper air-flow conduit 56 is designed to be attached between the upper surface 173 of the toilet bowl 168 and the toilet tank 162 and is comprised of a horizontal section 58 and an inwardly-angled side section 77.

Figure 5:
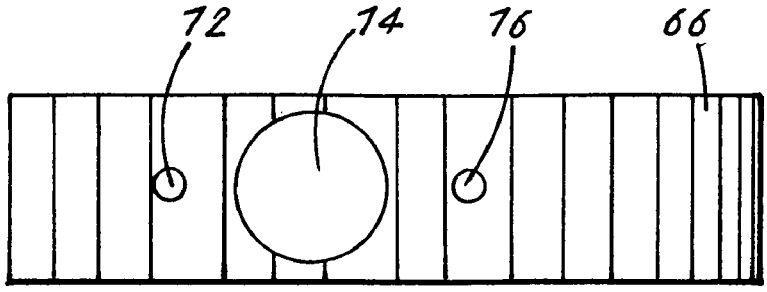
FIG. 5 is a top plan view of the upper air-flow conduit.
Figure 4:
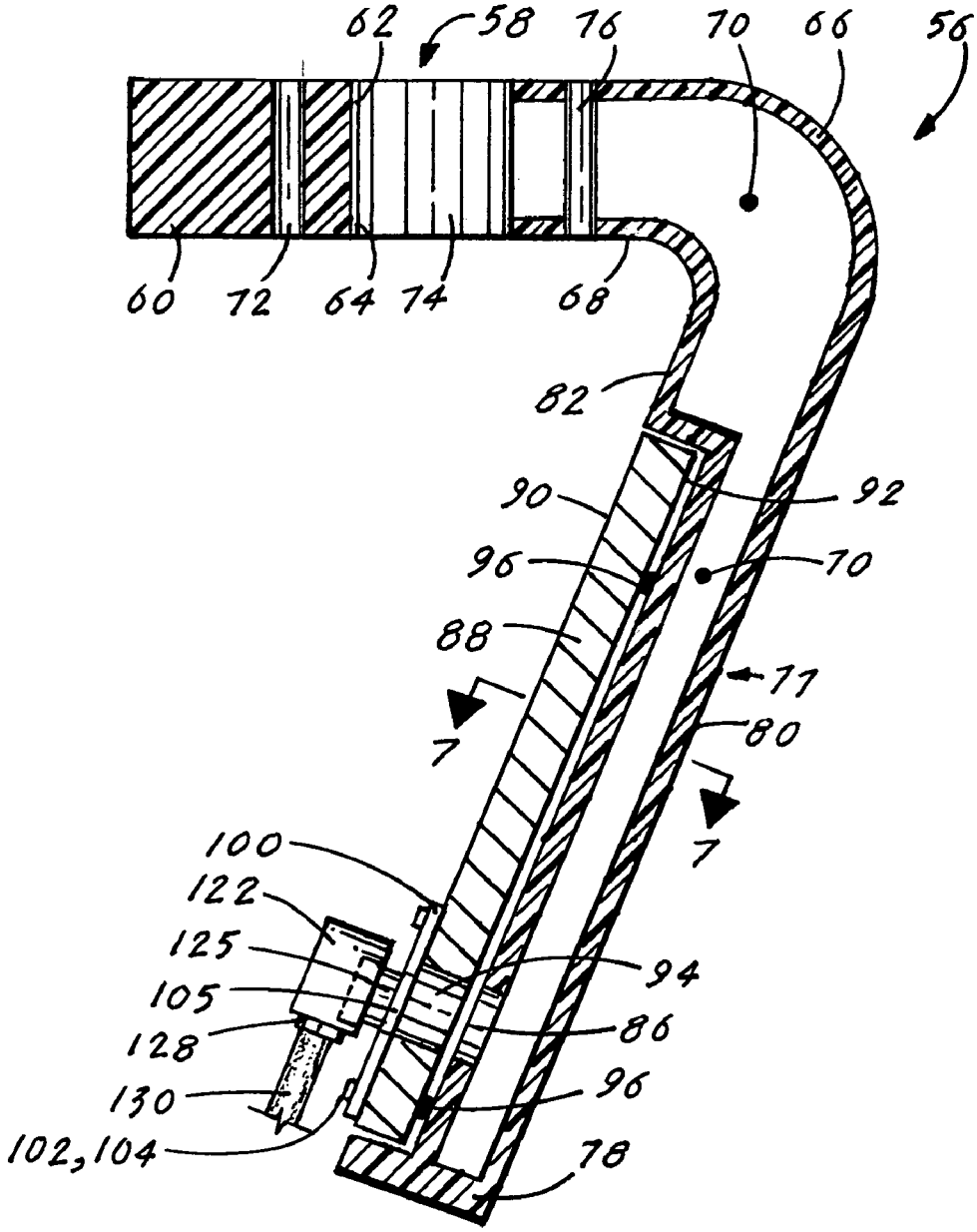
FIG. 4 is a side elevational and cross-sectional view of an upper air-flow conduit.

The horizontal section 58, as best shown in FIGS. 4 and 5, is comprised of an inward solid terminus 60 that has an upper side edge 62 and a lower side edge 64. From the upper side edge 62 extends an upper section 66 and integrally extending from the lower side edge 64 is a lower section 68. Between the upper section 66 and the lower section 68, as shown in FIG. 4, is formed an air passage 70. Also, extending through the inward solid terminus 60 is a first mounting bore 72 and located outward from the first mounting bore 72 is an upper air inlet port 74 that extends through the upper section 66 and the lower section 68 of said horizontal section 58. A second mounting bore 76 is located adjacent to the upper air-inlet port 74 that extends through the upper section 66 and the lower section 68 of the horizontal section 58.

Figure 6:
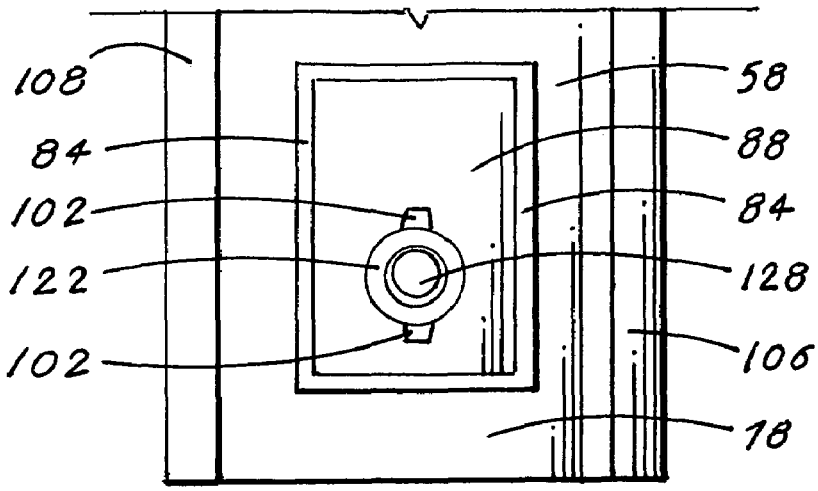
FIG. 6 is a partial elevational view of the inward section of the upper air-flow conduit showing a cover attached to a cavity.
Figure 7:
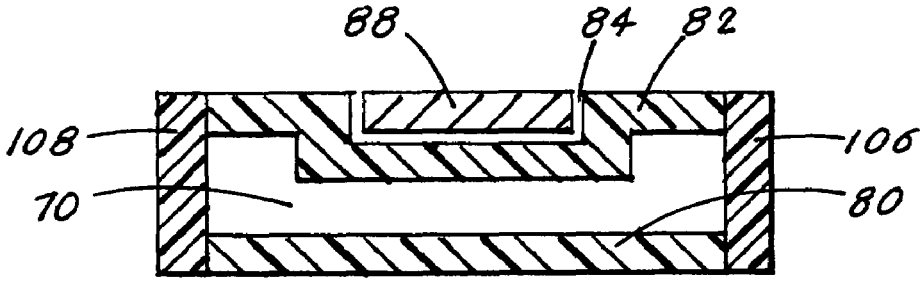
FIG. 7 is a cross-sectional view of the upper air-flow conduit taken along the lines 7-7 of FIG. 4.
Figure 8:
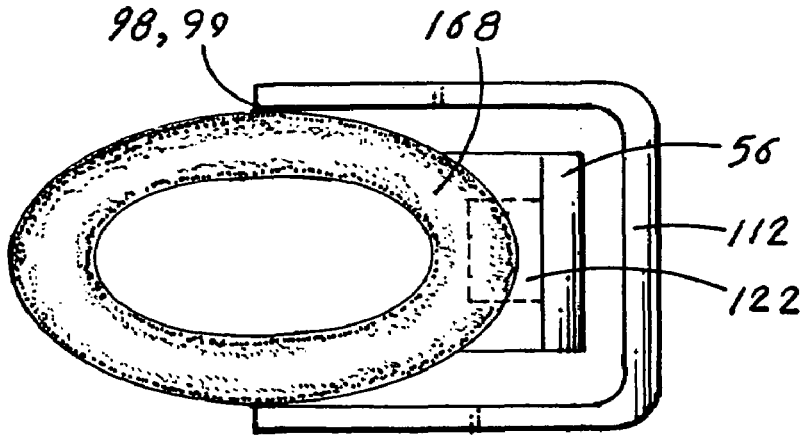
FIG. 8 is a top plan view of a rear enclosure that is attached to the rear section of the toilet tank.

The inwardly-angled section 77, as best shown in FIGS. 4, 6 and 7, is comprised of a lower solid terminus 78 and an outward section 80 that is integrally attached to the upper section 66 of the horizontal section 58. The outward section 80 extends downward at an angle that substantially follows the angular contour of the toilet bowl's 168 rear section 172 and integrally terminates at the lower solid terminus 78. The inwardly-angled section 77 also includes an inward section 82, a cover 88 and a motor/fan mounting bracket 100.

The inward section 82 is integrally attached to the lower section 68 of the horizontal section 58 and extends downward substantially at the same angle as that of the rear section 172 of the toilet bowl 168 and integrally terminates at the lower solid terminus 78. The inward section 82 includes a cover cavity 84, as shown in FIG. 4, that commences adjacent to the horizontal section 58 and that terminates adjacent to the lower solid terminus 78 and a first lower air exhaust port 86. The cover 88 has an upper surface 90 and a lower surface 92 that is dimensioned to fit into and be attached by a cover attachment means 96 to the cover cavity 84. The attachment means preferably consists of a water-proof adhesive. The cover 88 further has a second lower air exhaust port 94 that is in concentric alignment with the first lower air exhaust port 86.

A motor/fan mounting bracket 100 is attached to the upper surface 90 of the cover 88 by a bracket attachment means 102. The bracket 100 includes an air input port 105, has a lower edge that is located adjacent to the lower solid terminus 78, and is attached preferably by a set of screws 104. To complete the structure of the inwardly-angled section 77, a right side panel 106 and a left side panel 108 are utilized. Each of the panels 106,108 is dimensioned to follow the shape of the horizontal section 58 and the inwardly angled section 77. The two panels 106,108 are attached to each respective side of the upper air-flow conduit 56 by a panel attachment means 110, which preferably consists of a water-proof adhesive.

Figure 9:
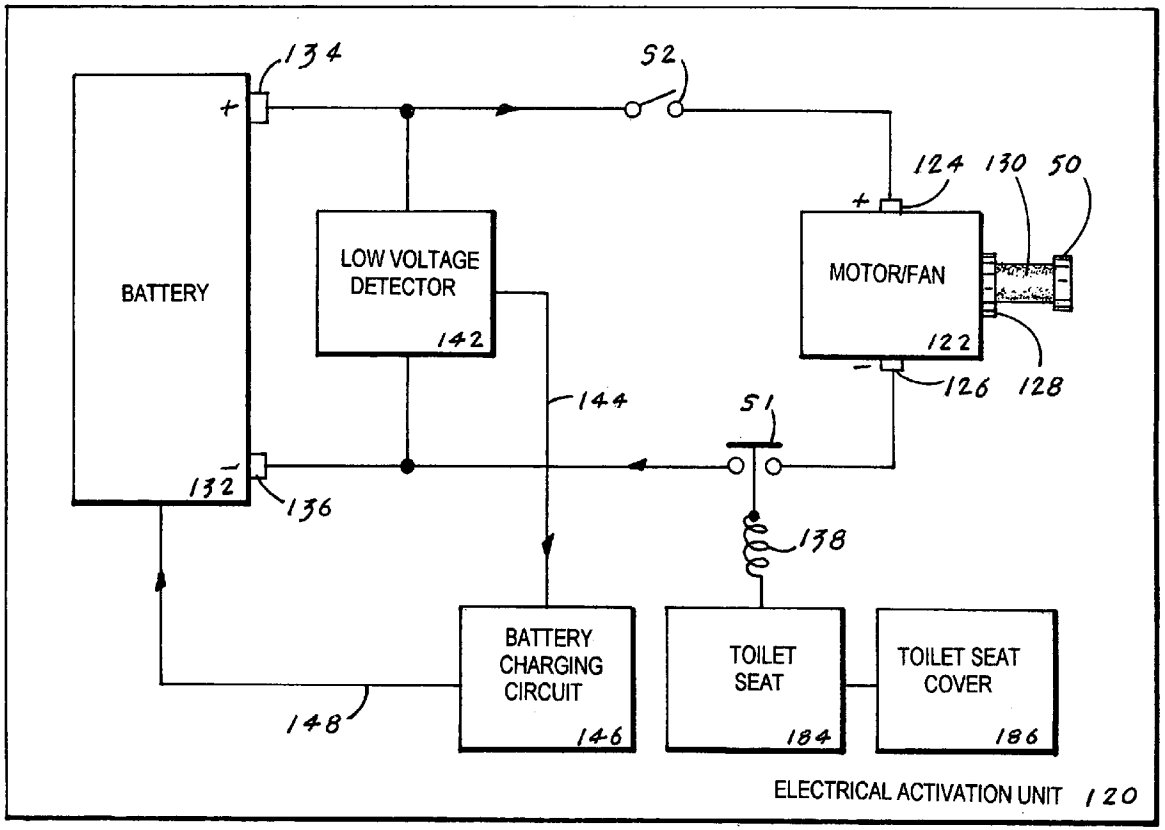
FIG. 9 is a block diagram of an electrical activation unit.

The third and final major element that comprises the kit form of the TOVA 10 is the electrical activation unit 120, which is shown in FIG. 9. The unit 120 is comprised in its basic design configuration of a battery 132, a motor/fan 122 and a switch S1.

The motor/fan 122, which is attached to the motor/fan mounting bracket 100, includes a positive input connection 124, a negative input connection 126, an air input duct 125 that interfaces with the air input port 105 located on the motor/fan mounting bracket 100, and an air exhaust duct 128 that is attached via an air hose 130 to the air exhaust port 50 located on the lower air-flow conduit 12. Preferably, the air hose 130 is comprised of a flexible air hose 130 to compensate for minor misalignments.

The battery 132 has a positive terminal 134 and a negative terminal 136. The positive terminal 134 is connected to the positive input connection 124 located on the motor/fan 122 and the negative terminal 136 is connected in series through the normally "off" switch S1 to the negative input connection 126 on the motor/fan 122. The pressure applied to the contact arm of the switch S1 is controlled by a spring 138 that biases the contact arm to maintain the switch S1 in an open position. When the toilet seat 184 is in an upward position the switch S1 remains open disabling the electrical activation unit 120. Also, when the toilet seat 184 and toilet seat cover 186 are placed in a downward position, the downward pressure applied by the toilet seat 184 and toilet seat cover 186 is insufficient to overcome the spring bias which causes the switch S1 to remain in its open position. However, when a person sits on the toilet seat the additional weight applied is sufficient to overcome the spring bias, thus allowing the switch S1 to close. The closed switch causes the battery voltage to be applied to and enable the motor/fan 122.

When the electrical activation unit 120 is operating an air-flow containing the toilet odor is created. The air-flow, which is shown by solid arrow lines in FIG. 1, commences at the toilet bowl 168 from where the air-flow enters through the plurality of the water outlet ports 180. The air-flow exiting the water outlet ports 180 enters into and exits from the water outlet opening 178 located on the toilet bowl 168, and continues through the air passage area 70 into the first lower air exhaust port 86, the second lower air exhaust port 94, the air input port 105 and into the air input duct 125 located on the housing of the motor/fan 122. From the motor/fan the air-flow travels through the air hose 130 into the air exhaust port 50 located on the lower air-flow conduit 12, and finally the air flow exits through the sewer port 46, the sewer opening 192, the waste pipe 198 and into the sewer.

To assure that the various interfacing air passages are hermetically sealed, gaskets 114 are placed around and between the sewer opening 182 located on the toilet bowl 168 and the sewer port 46 located on the lower air-flow conduit 12 and the sewer port 46 located on the lower air-flow conduit 12 and the sewer opening 192 located on the floor 190. The gaskets 114 are also placed around a bolt 188 that is inserted through the toilet tank attachment bore 166 and the first mounting bore 72 located on the upper air-flow conduit 56, the toilet tank attachment bore 166 and the second mounting bore 76 located on the upper air-flow conduit 56, the first mounting bore 72 located on the upper air-flow conduit 56 and the bowl mounting bore 176 and finally, the second mounting bore 76 located on the upper air-flow conduit 56 and the bowl mounting bore 176. The gaskets 114 that interface with the sewer opening 192 are selected from the group consisting of a wax seal 116, a resilient material 118 and a resilient O-ring 119. The gaskets 114 that interface with the toilet tank 162 and the toilet bowl 168 are selected from the group consisting of a resilient material 118 and a resilient O-ring 119.

To enhance the operation of the TOVA 10 the electrical activation unit 120 can be designed to include a master power switch S2, a rechargeable battery 132, a low voltage detector 142 and a battery charging circuit 146.

The master power switch S2 is connected in series between the positive terminal 134 of the rechargeable battery 132 and the positive input connection 124 on the motor/fan 122, wherein the switch S2 must be closed before the electrical activation unit 120 is enabled. The low-voltage indicator 142 is connected across the positive and negative terminals 134, 136 of the rechargeable battery 132. The low-voltage detector 142 produces a low voltage output signal 144 that is applied to the battery charging circuit 146 which produces a battery charge signal 148 that is applied to the rechargeable battery 132.

To increase the utility and the aesthetics of the TOVA 10 a removable rear enclosure 112 can be utilized. The removable rear enclosure 112 is designed to extend from the upper section 66 of the upper air-flow conduit 56 to the floor 190. It is also dimensioned to enclose the inward angled section 77 of the upper air-flow conduit 56, the electrical activation unit 120 and a portion of the rear section 172 of the toilet bowl 168. The enclosure is attached to the toilet bowl by an attachment means that preferably is comprised of a set of hook and loop fasteners 98 or a set of snap fasteners 99.

Figure 10:
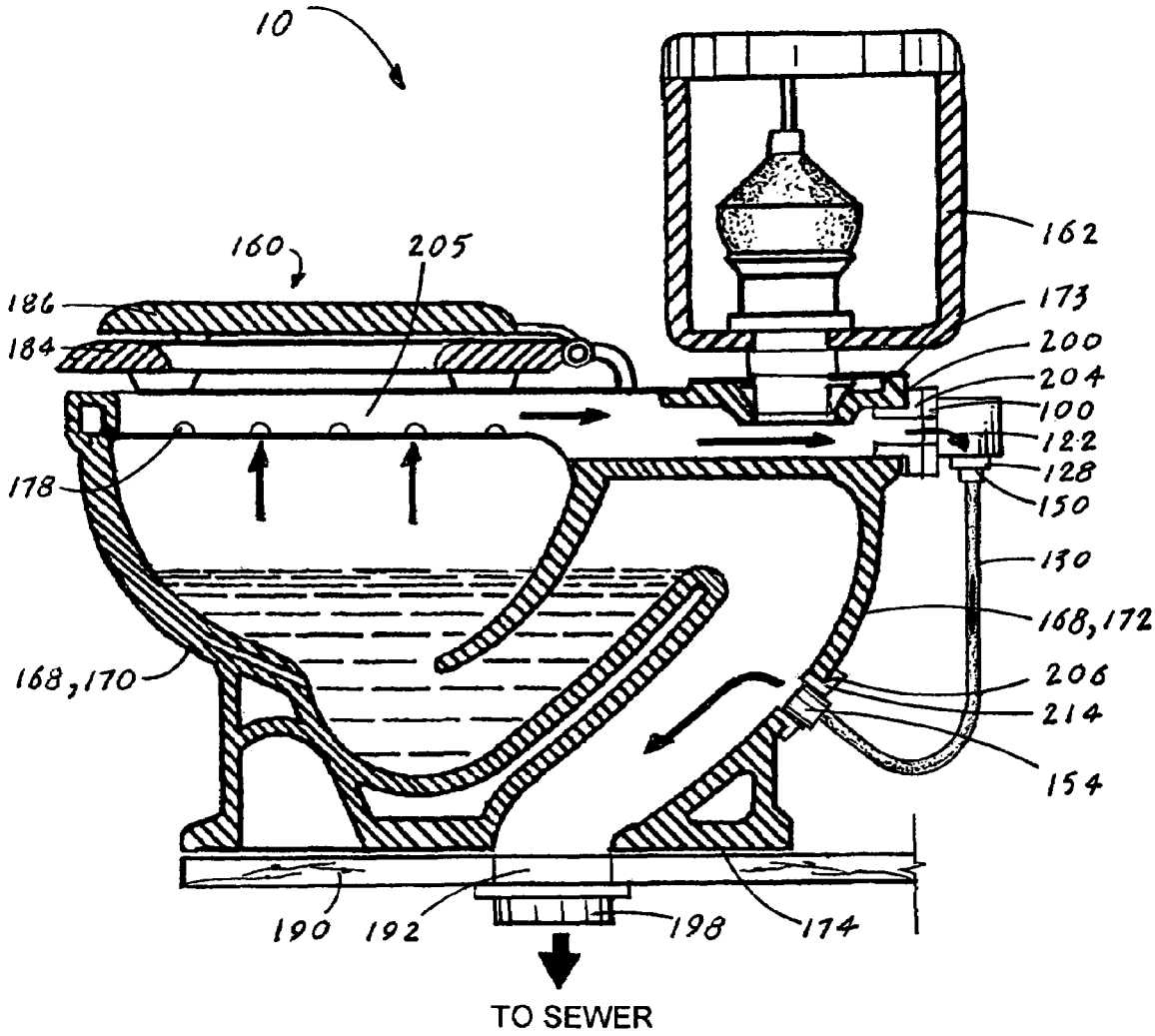
FIG. 10 is a side elevational view and cross-sectional view of a toilet odor ventilating assembly attached to a modified OEM toilet assembly.
Figure 11:
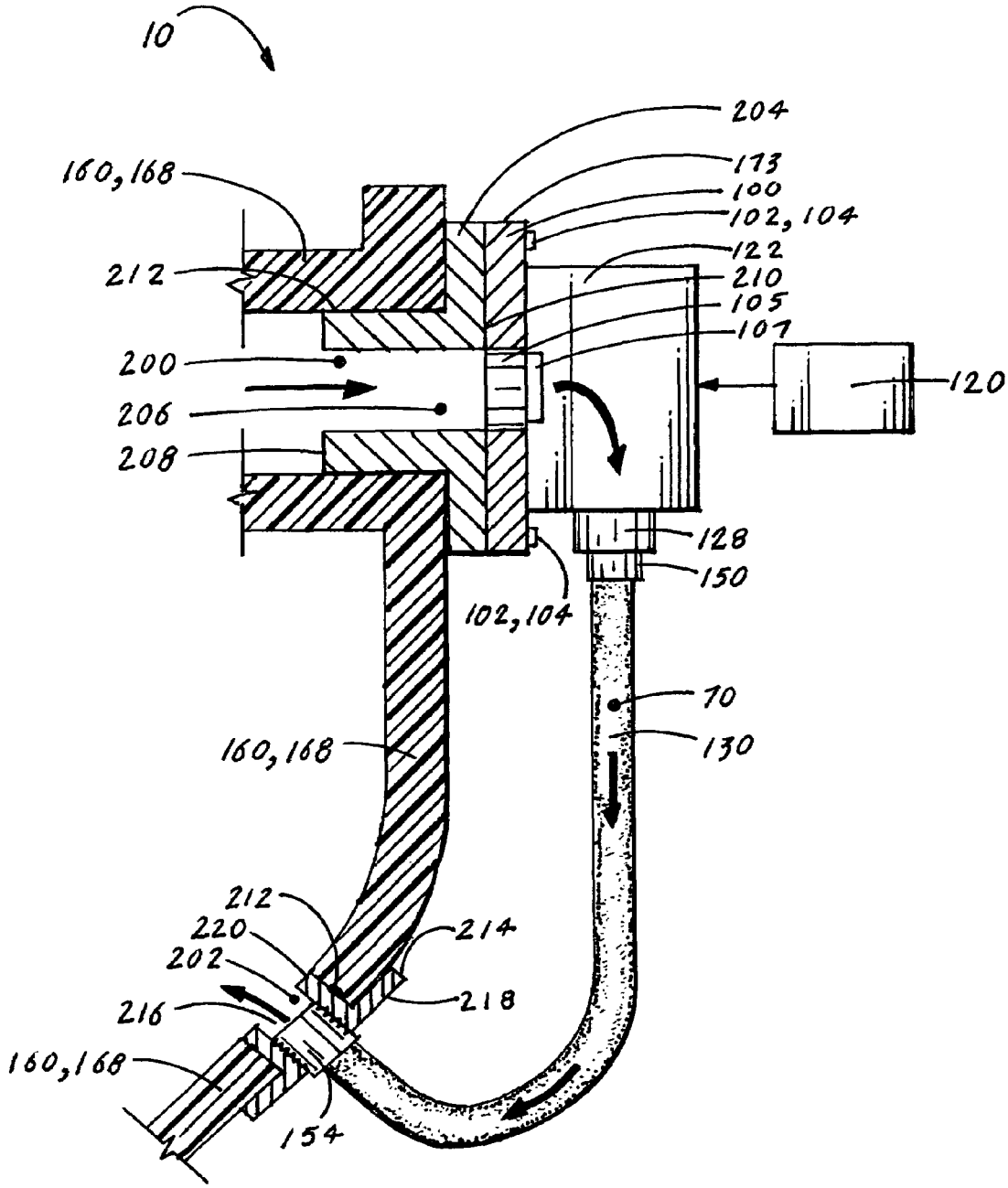
FIG. 11 is a partial, enlarged elevational view of a toilet odor ventilating assembly that is configured for application onto the OEM modified toilet assembly.

The TOVA 10 that is designed to be adapted for inclusion onto a modified OEM toilet assembly 160 is shown in FIGS. 10 and 11. The modifications made to the toilet assembly 160 consist of forming an air inlet opening 200 and an air outlet opening 202. The opening 200 is located adjacent to the bowls upper surface 173 and the opening 202 is located between the bowl's upper surface 173 and the bowl's lower surface 174. The remainder of the elements that comprise the toilet assembly 160 are as previously disclosed.

The OEM design of the TOVA 10 is comprised of an air inlet flange 204, an air outlet flange 214, a motor/fan mounting bracket 100, a motor/fan 122, a flexible hose 130 and an electrical activating unit 120.

The air inlet flange 204, as shown best in FIG. 11, is inserted into the air inlet opening 200 located on the toilet bowl 168 and is attached thereto by a flange attachment means 212. The flange 204 has an air passage bore 206, an inner surface 208 and an outer surface 210. The air outlet flange 214, as also shown in FIG. 11, is inserted into the air outlet opening 202 which is also located on the toilet bowl 168 and is attached thereto by a flange attachment means 212. The flange 214 has an air passage bore 216, an inner surface 218 and an outer surface 220.

The motor/fan mounting bracket 100 is attached to the outer surface 210 of the air inlet flange 204 by the flange attachment means 212. The bracket 100 further has an air input port 105 that is in alignment with the air passage bore 206 that is located on the air inlet flange 204. The motor/fan 122, which is located within a housing, is attached to the motor/fan mounting bracket 100. The housing includes an air input port 107 that is in alignment with the air input port 105 located on the motor/fan mounting bracket 100 and an air exhaust duct 128, as best shown in FIG. 11. The flexible hose 130 has a hose inlet coupler 150 that is attached to the air exhaust duct 128 located on the housing of the motor/fan 122 and a hose outlet coupler 154 that is attached to the air outlet flange 214.

The electrical activation unit 120, which is the final element that comprises the OEM design of the TOVA 10, has means for controlling the operation of the motor/fan 122, as previously described. When the motor/fan 122 is activated, an air flow as shown by solid arrowed lines in FIGS. 10 and 11, is produced that commences at the toilet bowl 168 from where the air-flow enters through the plurality of the water outlet ports 180. The air-flow exiting the water outlet ports 180 continues through a horizontal air passage 205 and into the air passage bore 206 located on the air inlet flange 204. From the flange 204 the air flow travels through the air input port 105 located on the motor/fan mounting bracket 100 and through the air exhaust duct 128 located on the housing of the motor/fan 122. From the air exhaust duct 128 the air-flow continues through the air hose 130 and exits at the hose's outlet coupler 154 and through the air passage bore 216 that is located on the air outlet flange 214. From the flange 214 the air re-enters the toilet bowl 168 where the air flow exits through the sewer opening 192 located on the floor 190, the waste pipe 198 and into the sewer.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A toilet odor ventilating assembly (TOVA) that is adapted to function in combination with a toilet assembly comprising: a toilet tank having a water outlet opening and at least one tank attachment bore, wherein the toilet tank is attached to a toilet bowl having a front section, a rear section, an upper surface, a lower surface, a pair of bowl mounting bores, a water outlet opening, a plurality of water outlet ports, a sewer opening, a toilet seat and a toilet seat cover, wherein the sewer opening is aligned with a sewer opening located through a floor having an upper surface and a lower surface, wherein the floor's sewer opening terminates with a waste pipe that extends from the lower surface of the floor and to which is connected a sewer pipe, wherein said TOVA comprises:

a) a lower air-flow conduit having a sewer port and an air exhaust port, wherein the sewer port interfaces with the sewer opening located on the toilet bowl and the sewer opening located on the floor, b) an upper air-flow conduit having a lower air exhaust port and an upper air inlet port, wherein the upper air inlet port interfaces with the water outlet openings located on the toilet tank and the toilet bowl, c) a motor/fan mounting bracket having an air input port that is aligned with the lower air exhaust port, d) a motor/fan enclosed within a housing having an air input duct that interfaces with the air input port located on the bracket, and an air exhaust duct that is connected via an air hose to the exhaust port located on said lower air-flow conduit, and e) an electrical activation unit having means for controlling the operation of the motor/fan, wherein when said motor/fan is activated, an air flow is produced that commences at the toilet bowl from where the air-flow enters through the plurality of the water outlet ports, wherein the air-flow exiting the water outlet ports enters into and exits from the water outlet opening and continues through an air passage into the lower air exhaust port, the air input port located on the motor/fan mounting bracket, the air input duct located on the motor/fan housing and into the air exhaust duct also located on the motor/fan housing, from the air exhaust duct the air-flow travels through the air hose into the air exhaust port located on said lower air flow conduit and finally the air flow exits through the sewer port, the sewer opening, the waste pipe and into the sewer, wherein said lower air-flow conduit further comprises:

a) a support structure having an elongated central opening, an upper surface and a lower surface, b) an upper plate having an upper surface, a lower surface, a front end and a rear end, wherein the upper plate is dimensioned to follow the perimeter of the support structure, wherein the lower surface of the upper plate is attached to the upper surface of the support structure by a plate attachment means, c) a lower plate having an upper surface and a lower surface, wherein the lower plate is dimensioned to also follow the perimeter of the support structure, wherein the upper surface of said lower plate is attached to the lower surface of said support structure by the plate attachment means, d) a sewer port that extends through the upper plate and the lower plate, wherein the sewer port is in alignment with the sewer opening on the toilet assembly, e) a pair of toilet and conduit mounting bores that extend through the upper plate, the support structure and the lower plate, wherein the toilet and conduit mounting bores are in alignment with the pair of bowl mounting bores located on the toilet assembly, f) an air exhaust port that extends through and is adjacent to the rear end of the upper plate, and g) a unit and battery mounting bracket that is also located adjacent to the rear end of the upper plate.

2. The assembly as specified in claim 1 wherein said upper air-flow conduit further comprises:

a) a horizontal section having:

(1) an inward solid terminus having an upper side edge and a lower side edge, (2) an upper section integrally extending from the upper side edge, (3) a lower section integrally extending from the lower side edge, wherein between the upper and lower sections is formed an air passage area, (4) a first mounting bore that extends through the inward solid terminus, (5) an upper air-inlet port that is located outward from the first mounting bore and that extends through the upper section and the lower section of said horizontal section, (6) a second mounting bore that is located adjacent to the upper air-inlet port and that extends through the upper and lower section of said horizontal section, b) an inwardly-angled side section having:

(1) a lower solid terminus, (2) an outward section that is integrally attached to the upper section of the horizontal section, extends downward at an angle that substantially follows the angular contour of the toilet bowl's rear section and integrally terminates at the lower solid terminus, (3) an inward section that is integrally attached to the lower section of the horizontal section and that extends downward substantially at the same angle as that of the rear section of the toilet bowl and integrally terminates at the lower solid terminus, wherein the inward section having a cover cavity that commences adjacent to the horizontal section and that terminates adjacent to the lower solid terminus and a first lower air exhaust port, (4) a cover having an upper surface and a lower surface, wherein the cover is dimensioned to fit into and be attached by a cover attachment means to the cover cavity, with the cover further having a second lower air exhaust port that is in concentric alignment with the first lower air exhaust port, (5) a motor/fan mounting bracket that is attached to the upper surface of the cover by a bracket attachment means, wherein the bracket having an air input duct that is aligned with the second lower air exhaust duct located on the cover and a lower edge that is located adjacent to the lower solid terminus, and (6) a right side panel and a left side panel, wherein each of the panels is dimensioned to follow the shape of the horizontal section and the inwardly angled section, wherein the two panels are attached to the respective sides of said upper air-flow conduit by a panel attachment means.

3. The assembly as specified in claim 1 wherein said electrical activation unit further comprises:

a) a motor/fan further having a positive input connection and a negative input connection, and b) a battery having a positive terminal and a negative terminal, wherein the positive terminal is connected to the positive input connection on said motor/fan and the negative terminal is connected in series through a normally "off" switch (S1) to the negative input connection on said motor/fan, wherein the pressure applied to the contact arm of said switch (S1) is controlled by a spring that biases the contact arm to maintain the switch (S1) in an open position, wherein when the toilet seat is in an upward position, the switch (S1) remains open, thereby disabling the unit, when the toilet seat and toilet seat cover are placed in a downward position, the downward pressure applied by the toilet seat and toilet seat cover is insufficient to overcome the spring bias which causes the switch (S1) to remain in its open position, when a person sits on the toilet seat the additional weight applied is sufficient to overcome the spring bias, thus allowing the switch (S1) to close which then causes the battery voltage to be applied to and enable said motor/fan, wherein when said electrical activation unit is operating, an air-flow containing the toilet odor is created; the air-flow commences at the toilet bowl from where the air-flow enters through the plurality of the water outlet ports, wherein the air-flow exiting the water outlet ports enters into and exits from the water outlet opening located on the toilet bowl and sequentially continues through the air passage area into the first lower air exhaust port, the second lower air exhaust port, the air input port located on the motor/fan mounting bracket, the air input duct located on the motor/fan and into the motor/fan input duct; from the motor/fan input duct, the air-flow travels through the air hose into the air exhaust port located on said lower air flow conduit and finally the air flow exits through the sewer port, the sewer opening, the waste pipe and into the sewer.

4. The assembly as specified in claim 3 wherein said battery is comprised of a rechargeable battery.

5. The assembly as specified in claim 4 wherein said electrical activation unit further comprises a master power switch (S2) that is connected in series between the positive terminal of the rechargeable battery and the positive input connection on the motor/fan, wherein the switch (S2) must be closed before said unit is enabled.

6. The assembly as specified in claim 5 wherein said electrical activation unit further comprises a low-voltage indicator that is connected across the positive and negative terminals of the rechargeable battery wherein the low-voltage detector produces a low voltage output signal that is applied to a battery charging circuit that produces a battery charge signal that is applied to the rechargeable battery.

7. The assembly as specified in claim 3 further comprising a removable enclosure that is designed to extend from the upper section of said upper air-flow conduit to the floor and to enclose the inward angled section of said upper air-flow conduit, said electrical activation unit and a portion of the rear section of the toilet bowl, wherein said enclosure is attached to the toilet bowl by an attachment means.

8. A toilet odor ventilating assembly (TOVA) that is adapted to function in combination with a toilet assembly comprising a toilet tank having a water outlet opening and at least one tank attachment bore, wherein the toilet tank is attached to a toilet bowl having a front section, a rear section, an upper surface, a lower surface, a pair of bowl mounting bores, a water outlet opening, a plurality of water outlet ports, a sewer opening, a toilet seat and a toilet seat cover, wherein the sewer opening is aligned with a sewer opening located through a floor having an upper surface and a lower surface, wherein the floor's sewer opening terminates with a waste pipe that extends from the lower surface of the floor and to which is connected a sewer pipe, wherein said TOVA comprises:

a) a lower air-flow conduit that is attached between the lower surface of the toilet bowl and the upper surface of the floor, said lower air-flow conduit having a perimeter that encompasses the lower surface of the toilet bowl, said lower air-flow conduit comprising:

(1) a support structure having an elongated central opening, an upper surface and a lower surface, (2) an upper plate having an upper surface, a lower surface, a front end and a rear end, wherein the upper plate is dimensioned to follow the perimeter of the support structure, wherein the lower surface of the upper plate is attached to the upper surface of the support structure by a plate attachment means, (3) a lower plate having an upper surface and a lower surface, wherein the lower plate is dimensioned to also follow the perimeter of the support structure, wherein the upper surface of said lower plate is attached to the lower surface of said support structure by the plate attachment means, (4) a sewer port that extends through the upper plate and the lower plate, wherein the sewer port is in alignment with the sewer opening on the toilet assembly, (5) a pair of toilet and conduit mounting bores that extend through the upper plate, the support structure and the lower plate, wherein the toilet and conduit mounting bores are in alignment with the pair of bowl mounting bores located on the toilet assembly, (6) an air exhaust port that extends through and is adjacent to the rear end of the upper plate, (7) a unit and battery mounting bracket that is also located adjacent to the rear end of the upper plate, b) an upper air-flow conduit that is attached between the upper surface of the toilet bowl and the toilet tank, wherein said upper air-flow conduit comprises:

(1) a horizontal section having:

(a) an inward solid terminus having an upper side edge and a lower side edge, (b) an upper section integrally extending from the upper side edge, (c) a lower section integrally extending from the lower side edge wherein between the upper and lower sections is formed an air passage area, (d) a first mounting bore that extends through the inward solid terminus, (e) an upper air-inlet port that is located outward from the first mounting bore and that extends through the upper section and the lower section of said horizontal section, (f) a second mounting bore that is located adjacent to the upper air-inlet port and that extends through the upper and lower section of said horizontal section, (2) an inwardly-angled side section having:

(a) a lower solid terminus, (b) an outward section that is integrally attached to the upper section of the horizontal section, extends downward at an angle that substantially follows the angular contour of the toilet bowl's rear section and integrally terminates at the lower solid terminus, (c) an inward section that is integrally attached to the lower section of the horizontal section and that extends downward substantially at the same angle as that of the rear section of the toilet bowl and integrally terminates at the lower solid terminus, wherein the inward section having a cover cavity that commences adjacent to the horizontal section and that terminates adjacent to the lower solid terminus and a first lower air exhaust port, (d) a cover having an upper surface and a lower surface, wherein the cover is dimensioned to fit into and be attached by a cover attachment means to the cover cavity, with the cover further having a second lower air exhaust port that is in concentric alignment with the first lower air exhaust port, (e) a motor/fan mounting bracket that is attached to the upper surface of the cover by a bracket attachment means, wherein the bracket having an air input port that is aligned with the second lower air exhaust port located on the cover and a lower edge that is located adjacent to the lower solid terminus, (f) a right side panel and a left side panel, wherein each of the panels is dimensioned to follow the shape of the horizontal section and the inwardly angled section, wherein the two panels are attached to the respective sides of said upper air-flow conduit by a panel attachment means, c) an electrical activation unit comprising:

(1) a motor/fan that is attached to the motor/fan mounting bracket, said motor/fan having a positive input connection, a negative input connection and an air exhaust duct that is attached via an air hose to the air exhaust port located on said lower air-flow conduit, and (2) a battery having a positive terminal and a negative terminal, wherein the positive terminal is connected to the positive input connection on said motor/fan and the negative terminal is connected in series through a normally "off" switch (S1) to the negative input connection on said motor/fan, wherein the pressure applied to the contact arm of said switch (S1) is controlled by a spring that biases the contact arm to maintain the switch (S1) in an open position, wherein when the toilet seat is in an upward position, the switch (S1) remains open, thereby disabling said unit, when the toilet seat and toilet seat cover are placed in a downward position, the downward pressure applied by the toilet seat and toilet seat cover is insufficient to overcome the spring bias which causes the switch (S1) to remain in its open position, when a person sits on the toilet seat the additional weight applied is sufficient to overcome the spring bias, thus allowing the switch (S1) to close which then causes the battery voltage to be applied to and enable said motor/fan, wherein when said electrical activation unit is operating, an air-flow containing the toilet odor is created; the air-flow commences at the toilet bowl from where the air-flow enters through the plurality of the water outlet ports, wherein the air-flow exiting the water outlet ports enters into and exits from the water outlet opening located on the toilet bowl and continues through the air passage area into the first lower air exhaust port, the second lower air exhaust port, the air input port located on the motor/fan mounting bracket, the air input duct located on the motor/fan and into the motor/fan input duct; from the motor/fan input duct, the air-flow travels through the air hose into the air exhaust port located on said lower air flow conduit and finally the air flow exits through the sewer port, the sewer opening, the waste pipe and into the sewer.

9. The assembly as specified in claim 8 further comprising a gasket that is placed around and between:

a) the sewer opening located on the toilet bowl and the sewer port located on said lower air-flow conduit, b) the sewer port located on said lower air-flow conduit and the sewer opening located on the floor, c) a bolt inserted through:

(1) a toilet tank attachment bore and the first mounting bore located on said upper air-flow conduit; and (2) a toilet tank attachment bore and the second mounting bore located on said upper air-flow conduit, d) a bolt inserted through:

(1) the first mounting bore located on said upper air-flow conduit and the bowl mounting bore and, (2) the second mounting bore located on said upper air-flow conduit and the bowl mounting bore.

10. The assembly as specified in claim 9 wherein the gaskets that interface with the sewer opening are selected from the group consisting of a wax seal, a resilient material and a resilient O-ring.

11. The assembly as specified in claim 9 wherein the gaskets that interface with the toilet tank and the toilet bowl are selected from the group consisting of a resilient material and a resilient O-ring.

12. The assembly as specified in claim 8 further comprising a removable enclosure that is designed to extend from the upper section of said upper air-flow conduit to the floor and to enclose the inward angled section of said upper air-flow conduit, said electrical activation unit and a portion of the rear section of the toilet bowl, wherein said enclosure is attached to the toilet bowl by an attachment means.

13. The assembly as specified in claim 12 wherein said enclosure attachment means comprises a set of hook and loop fasteners or a set of snap fasteners.

14. The assembly as specified in claim 8 wherein the air hose is comprised of a flexible air hose.

15. The assembly as specified in claim 8 wherein said battery is comprised of a rechargeable battery.

16. The assembly as specified in claim 15 wherein said electrical activation unit further comprises a master power switch (S2) that is connected in series between the positive terminal of the rechargeable battery and the positive input connection on the motor/fan, wherein the switch (S2) must be placed in a closed position before said unit is enabled.

17. The assembly as specified in claim 16 wherein said electrical activation unit further comprises a low-voltage indicator that is connected across the positive and negative terminals of the rechargeable battery, wherein the low-voltage detector produces a low voltage output signal that is applied to a battery charging circuit that produces a battery charge signal that is applied to the rechargeable battery.

18. The assembly as specified in claim 8 wherein the plate attachment means and the cover attachment means comprise a water-proof adhesive.

19. The assembly as specified in claim 8 wherein said bracket attachment means comprises a set of screws.

* * * * *